United States Patent [19]

Fricker

[11] Patent Number: 4,739,602

[45] Date of Patent: Apr. 26, 1988

[54] DEVICE FOR ANCHORING PANELS

[76] Inventor: Siegfried Fricker, 30-34 Wurmberger Strasse, D-7135 Wiernsheim, Fed. Rep. of Germany

[21] Appl. No.: 48,872

[22] Filed: May 12, 1987

[30] Foreign Application Priority Data

May 14, 1986 [DE] Fed. Rep. of Germany ..... 3616210

[51] Int. Cl.[4] ..... E04F 13/08

[52] U.S. Cl. ..... 52/702; 52/235; 52/508; 52/704; 52/713; 411/433

[58] Field of Search ..... 52/235, 713, 508, 509, 52/702, 704; 403/118; 411/433, 432; 248/231.9, 300

[56] References Cited

U.S. PATENT DOCUMENTS

| | | | |
|---|---|---|---|
| 467,866 | 1/1892 | Satley | 403/118 |
| 1,683,516 | 9/1928 | Adams | 403/118 |
| 2,250,787 | 7/1941 | Anderson | 411/433 |

FOREIGN PATENT DOCUMENTS 0132003 7/1984 European Pat. Off. .

*Primary Examiner*—Henry E. Raduazo

*Attorney, Agent, or Firm*—Foley & Lardner, Schwartz, Jeffery, Schwaab, Mack, Blumenthal & Evans

[57] ABSTRACT

Facing panels can be fastened by the anchoring device of the invention to a building wall or similar anchoring base. The anchoring device has a pair of angular holders, each of which includes a holding part, fixable to the anchoring base, and a supporting part projecting horizontally. A bolt has an outer receptacle for the panels to be fastened and is formed with toothing by means of which the bolt can be mounted in the horizontal supporting parts adjustably and so as to be surrounded in a box-like manner over its axial length. For this purpose, by means of the toothing, the bolt is clamped on opposite longitudinal sides between two separate clamping plates which form the horizontal supporting parts and which are connected by means of tension parts located on both sides of the bolt. At least one of these tension parts is adjustable.

12 Claims, 2 Drawing Sheets

DEVICE FOR ANCHORING PANELS

BACKGROUND OF THE INVENTION

The invention relates to a device for anchoring panels, especially facing panels, to an anchoring base such as a building wall or the like.

A known device of this type (European Preliminary Patent Publication No. 0,132,003) has a vertical holding part designed as a bent sheet-metal part and a supporting part which projects horizontally and which is likewise designed as a bent sheet-metal part. The holding part and the supporting part are combined to form an angular holder, the connection being made by spot welding in the region of the corner of the angle. The horizontal supporting part is designed as a sleeve which is bent from a relatively wide sheet-metal blank and which is likewise held together by means of a welded joint. A female thread has to be cut in this sleeve of the supporting part and can have screwed into it a horizontal threaded bolt which, at its projecting end, has receiving pegs for the facing panels or the like which are to be fastened. The production of this device is time-consuming and expensive because of the different bent sheet-metal parts, the welded joints and the thread-cutting work. The loads and wind and suction forces exerted subject the spot-welded connection to stress, and the device cannot ensure that the forces will be absorbed in an absolutely reliable way, with the result that it is impossible to meet stringent safety requirements in approval tests.

Furthermore, the bent design is a disadvantage, inasmuch as it can be deformed under the effect of loads, and because of this there is also uncertainty from a static point of view. A further disadvantage is that the axial adjustment of the threaded bolt to obtain an exact alignment of the facing panels is complicated and time-consuming, since it has to be rotated a relatively large number of times in order to adjust it axially over a relatively long distance. Readjustment when the wall panel is already fitted involves a particularly high outlay of time, since, for this purpose, either the panel has to be removed from the receiving peg or the angular holder has to be detached from the wall as a whole by releasing the fastening screw, so that adjustment can then be made by means of the thread. Moreover, there is a certain instability because of the play which necessarily exists between the threaded bolt and the threaded sleeve. To secure the threaded bolt against such looseness and against unintentional rotation, an additional lock nut is conventionally attached, but this restricts the adjustment distance of the threaded bolt, so that the facing panel cannot be brought directly close up to the free end of the horizontal supporting part.

SUMMARY OF THE INVENTION

The object of the invention is to develop a panel anchoring device of the type described, and capable of economical production and an absolutely firm fit of the adjusting bolt, with coarse and fine adjustment being quickly and easily carried out.

Preferred embodiments and developments, further advantages and essential details of the invention will be apparent from the following description and the drawings which show preferred exemplary embodiments in a diagrammatic representation.

BRIEF DESCRIPTION OF THE APPLICATION DRAWINGS

DETAILED DESCRIPTION OF THE PREFERRED EMBODIMENTS

Figure 1:
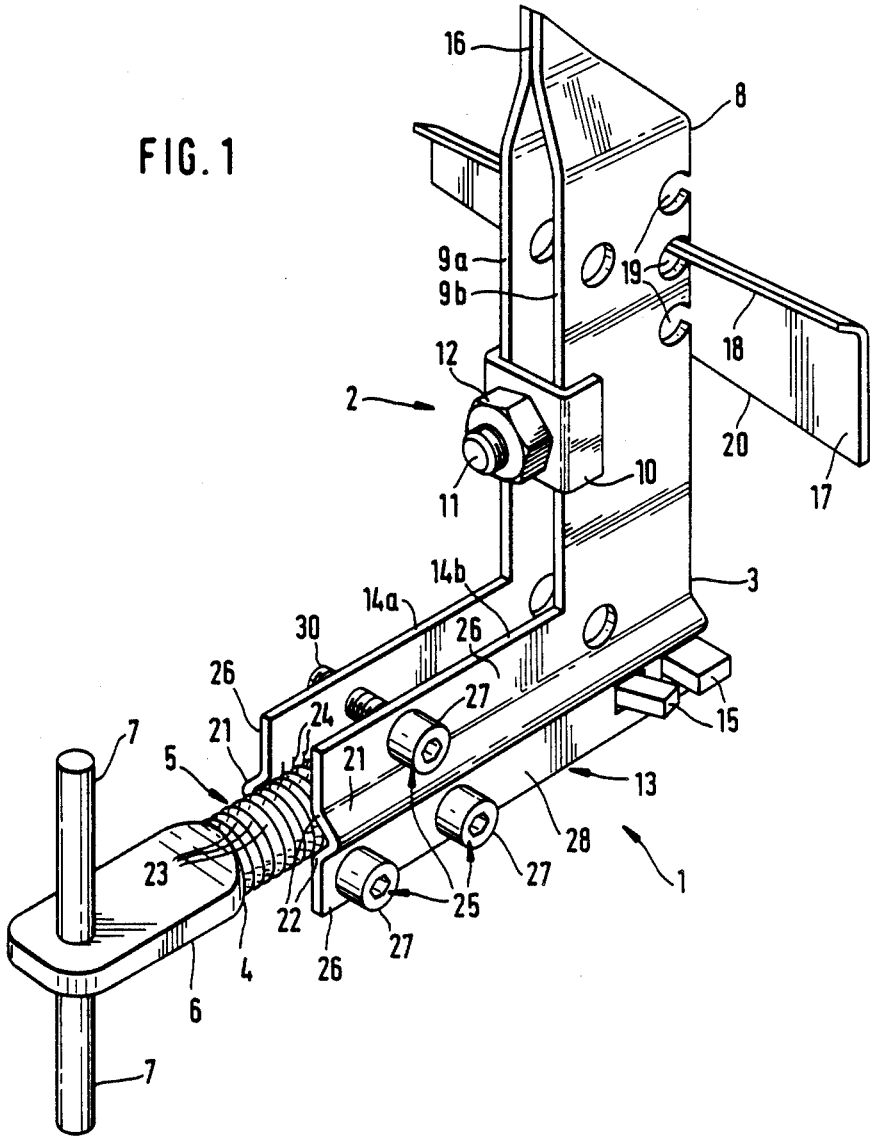
FIG. 1 is a perspective view of the anchoring device according to the invention.

The anchoring device 1 according to the invention can be fastened, via an anchoring element 2, to a vertical anchoring base, such as a building wall or the like, not shown. The anchoring device 1 possesses an angular holder 3 and a bolt 4 having a threaded part 5 and a flat-rectangular end part 6 outwardly of the threaded part and on which are arranged peg-like receptacles 7 extending transversely relative both to the plane of the flat end 6 and to the longitudinal axis of the bolt 4. Facing panels, not shown, which are approximately parallel to and spaced outwardly from the building wall can be fastened to the receiving pegs 7. The receiving pegs 7 preferably engage into corresponding holes made in the corner regions of the facing panels. So that the facing panels can be aligned exactly both with one another and with the building wall, an exact adjustment can be made in different directions via the anchoring device 1, both vertically, horizontally and diagonally, and even readjustments can be carried out without the facing panels having to be removed. Moreover, the anchoring device 1 as a whole is made so stable that even very high wind, suction and pressure forces are absorbed in an absolutely reliable way, with the result that the facing panels are fixed in front of the building wall firmly and free of play or free of shaking.

The angular holder 3 illustrated in the drawing possesses a vertical holding part 8 which can be fixed to the building wall and which has two parallel flat holding struts 9*a*, 9*b* perpendicular to the surface of the wall or anchoring base. Located between the two holding struts 9*a*, 9*b* is the anchoring element 2 which can preferably be designed as a screw-bolt connection and which has a U-shaped shackle 10 made preferably from flat iron and which engages over the two holding struts 9*a*, 9*b*. The fastening screw 11 passes through the shackle 10 in a horizontal slot, not shown, with the result that the holder 3 can be adjusted horizontally in the plane of the building wall. The fastening screw 11 is secured to the wall or anchoring base. A threaded nut 12 presses firmly against the shackle 10, so that the holder 3, when fitted, is fixed immovably.

The horizontal supporting part 13 of the angular holder 3 consists of two clamping plates 14*a*, 14*b* parallel to one another. The vertical holding struts 9*a*, 9*b* and the horizontal clamping plates 14*a*, 14*b* lie respectively in the same vertical parallel planes. Both the holding strut 9*a* and clamping plate 14*a* and the holding strut 9*b* and clamping plate 14*b* are designed as angular stamped articles, resulting in a one-piece design integral in terms of material, having great strength and also being economical to produce. Suitable stiffening parts 15 can be arranged in the outer region of the corner of the angle of the holder 3, thus increasing the stability and bending resistance of the holder 3. In the upper end region, the two holding struts 9a, 9b are bent towards one another and connected together, and this connection can preferably be in the form of a welded joint 16.

So that the anchoring device 1 can also be adjusted continuously in the vertical direction, a wedge plate 17 is provided. The wedge plate 17 has an edge 18 which is bent towards the holder 3 and which engages recesses 19 made on the rear side of the holding struts 9a, 9b which faces the building wall. The lower edge 20 of the wedge plate 17 extends obliquely and rests on the fastening screw 11. The height of the anchoring device 1 can thus be adjusted by shifting the wedge plate 17 horizontally.

The two clamping plates 14a, 14b each have a longitudinal bead 21 which extends horizontally preferably over the entire length of the clamping plates 14a, 14b. The longitudinal beads 21 are of prism-shaped cross-section, so that the bolt 4 or its threaded part 5 rests linearly against two parallel longitudinal edges 22 by means of the toothing 23 on part 5. This automatically ensures that the bolt 4 is centered positively in the longitudinal bead 21, so that, in an especially advantageous way, different bolts 4 with different thread-pitch diameters can also be used according to choice, positive centering in the longitudinal direction bead 21 always taking place, without the bulge of the longitudinal bead 21 having to be shaped or matched to the particular diameter of the threaded part 5. Since each of the two clamping plates 14a, 14b has a longitudinal bead 21, the threaded part 5 of the bolt 4 of the exemplary embodiment is clamped between a total of four parallel linear longitudinal edges 22. It is not absolutely necessary for the bolt 4 to have the toothing 23, since even a simple round bolt or the like would be held firmly by the longitudinal edges 22 of the clamping plates 14a, 14b pressed linearly against it, although the toothing 23 ensures additional retention. It is also possible to provide a toothing solely on the inner faces of the clamping plates 14a, 14b in the region of the longtiduinal beads 21.

Figure 2:
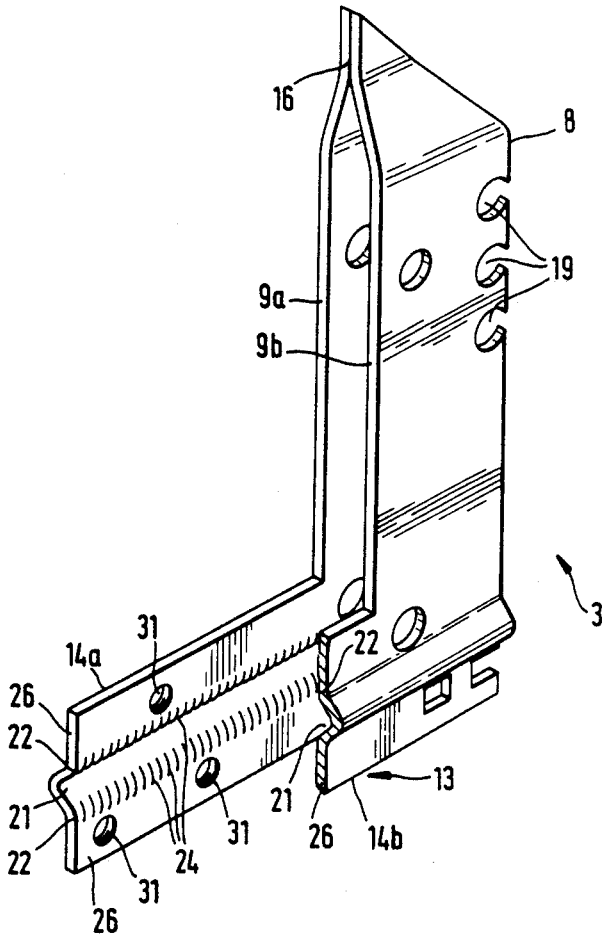
FIG. 2 is a perspective view of the angular holder of the anchoring device according to FIG. 1, with a leg of the supporting part being partially cut off.

It can be seen particularly in FIG. 2 that, preferably in the region of each of the longitudinal edges 22 of the prism-shaped longitudinal beads 21, there can be a detent toothing 24 which is engaged with the toothing 23 of the threaded part 5, thus ensuring that the bolt 4 is retained especially securely. The toothing 23 of the bolt 4 and the detent toothing 24 of the clamping plates 14a, 14b do not have to be of the same design, but can also be made directly different from one another. For example, the detent toothing 24 can have a substantially smaller tooth pitch than the toothing 23 of the threaded part 5. It is also possible to equip the bolt 4 with a fine-pitch thread which engages into a distinctly coarser detent toothing 24 of the longitudinal edges 22. By means of a small tooth pitch of the threaded part 5 and/or of the detent toothing 24, a fine horizontal adjustment can be made merely by shifting the bolt 4 axially, without the latter having to be rotated.

FIG. 1 makes it clear that the two separate clamping plates 14a, 14b surrounding the bolt 4 or its threaded part 5 are drawn together by means of tension parts which are preferably designed as tension screws 25. The threaded part 5 of the bolt 4 is clamped absolutely firmly between the clamping plates 14a, 14b as a result of the prestressing force of the tension screws 25, so that both a positive and a non-positive connection is made. The releasable tension screws 25 according to FIG. 1 are located in the region of web parts 26 of the clamping plates 14a, 14b. Between the two web parts 26 of each clamping plate 14a, 14b, the longitudinal bead 21 is preferably made symmetrically. The tension screw 25 has a head 27 which can have a hexagon socket (Inbus) for the engagement of an actuating tool and which rests against the outer face 28 of the web part 26. The tension screw 25 passes through a bore 29 in the web part 26 of one clamping plate 14b and engages by means of a threaded end 30 into a threaded hole 31 in the opposite web part 26 of the other clamping plate 14a. Instead of the threaded hole 31, a nut can also be screwed onto the threaded end 30.

In the exemplary embodiment of FIG. 1, there is a total of three tension screws 25 which are arranged in the form of a triangle. In this, two tension screws 25 are located in the lower web parts 26 of the clamping plates 14a, 14b, while the third tension screw 25 on the other side of the bolt 4 connects the upper web parts 26 of the two clamping plates 14a, 14b. It is also possible to provide, on each side of the bolt 4, only one tension screw 25 connecting the web parts 26. However, four or more tension screws 25 can also be provided for bracing the clamping plates 14a, 14b against the threaded part 5 of the bolt 4. Merely by releasing the upper tension screw 25, the clamping 14a, 14b can be loosened to such an extent that the bolt 4 can be rotated about its axis. If the lower tension screws 25 are released in addition, the distance between the two clamping plates 14a, 14b can be increased to such an extent that the threaded part 5 is disengaged, so that the bolt 4 can be adjusted quickly in the axial direction simply by being shifted. When the tension screws 25 are subsequently tightened, the longitudinal edges 22 of the clamping plates 14a, 14b are consequently pressed so firmly against the threaded part 5 that the bolt 4 is clamped in the horizontal supporting part 13 absolutely securely against displacement and rotation.

Figure 3:
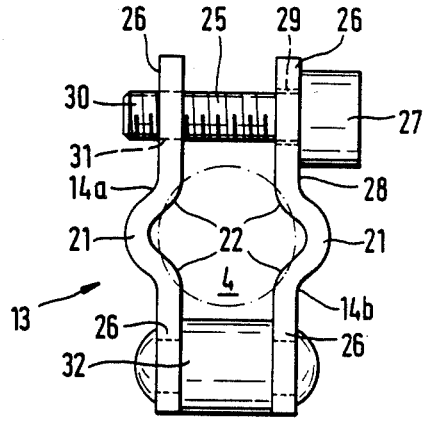
FIG. 3 is a front elevational view of the horizontal supporting part of the anchoring device shown in FIG. 1.

The exemplary embodiment of FIG. 3 shows that it can also be beneficial on one side, for example, the lower side, of the bolt 4, to connect the web parts 26 of the clamping plates 14a, 14b to one another by means of a non-adjustable connecting web which can preferably be designed as a riveted bolt 32, thereby making it possible to achieve particularly simple production. Only on the opposite (upper) side of the bolt 4 is there a tension screw 25, by means of which the two clamping plates 14a, 14b can be braced relative to one another, so that an aboslutely firm fit of the bolt 4 can be obtained via the linear four-point contact of the longitudinal edges 22. FIG. 3 shows particularly clearly that, because of the prism-shaped design of the longitudinal beads 21, bolts 4 of greatly differing diameters can be clamped firmly between the clamping plates 14a, 14b.

A further essential advantage of the clamping-plate design according to the invention is that there is no need for an additional lock nut for the bolt 4, since the bolt is secured by means of the clamping force exerted via the tenison screws 25. Since a lock nut is no longer necessary, the bolt 4 can be inserted axially into the supporting part 13 so far that even the portion of the flat end part 6 adjoining the threaded part 5 projects somewhat into the region of the beads 21, with the result that the facing panels to be fastened to the receptacles 7 can be brought close up to the anchoring device 1. In general, the anchoring device 1 according to the invention is an ideally variable anchoring system which allows many possibilities of simple adjustment, obtains an exact plane-parallel alignment of the facing panels, and which is also simple to produce and is of a high strength, guaranteeing an absolutely firm retention of the facing panels in any set position.

What is claimed is:

1. An anchoring device for anchoring panels or the like to an anchoring base such as a building wall, comprising:

(a) a pair of spaced angular holders, each holder comprising a holding part adapted to be rigidly attached to such anchoring base and a clamping plate which projects substantially horizontally in a direction away from such anchoring base, said clamping plates forming a supporting part of the device, (b) a bolt having a generally horizontal axis and postioned between said clamping plates, said bolt having receptacle means for engaging such panels or the like, and toothing on its exterior surface for longitudinally adjusting said bolt relative to said clamping plates, said clamping plates engaging said bolt at least at the side regions of said bolt, and (c) releasable tensioning means transversely interconnecting said clamping plates above and below said bolt, at least certain of said tensioning means being constructed and arranged so as to permit adjustment of the spacing between said clamping plates whereby said bolt can be firmly clamped between said plates or released for longitudinal movement of said bolt relative to said plates so as to vary the spacing of such panels from the anchoring base.

2. A device as claimed in claim 1, wherein at least one of the clamping plates has a prism-shaped longitudinal bead which extends over at least a part of the length of said horizontal clamping plate, said bead forming two parallel longitudinal edges which lineraly encompass said bolt.

3. A device as claimed in claim 1 wherein the bolt is clamped between prism-shaped longitudinal beads formed on both of said clamping plates, said beads providing four linear contact surface for said bolt.

4. A device as claimed in claim 2, wherein a detent toothing is formed on said at least one longitudinal edge of the prism-shaped longitudinal bead, the toothing on said bolt being in the form of a screw thread which engages said detent toothing.

5. A device as claimed in claim 4, wherein the detent toothing formed on said at least one longitudinal edge of the prism-shaped longitudinal bead, and the toothing of the bolt are different from one another.

6. A device as claimed in claim 5, wherein the tooth pitch of the detent toothing on said longitudinal edge of the longitudinal bead is smaller than the pitch of the toothing of the bolt.

7. A device as claimed in claim 3, wherein each of said clamping plates includes web parts extending substantially over the entire length of said clamping plates, and wherein said longitudinal beads are formed in said clamping plates between said webs.

8. A device as claimed in claim 1, wherein said releasable tensioning means comprises at least one tension screw which presses the two clamping plates against the bolt, said clamping plates being formed with web portions through which said tension screw passes.

9. A device as claimed in claim 8, wherein said tension screw rests by means of a head against an outer face of the web part of one clamping plate and is mounted by means of a threaded end in a threaded hole in the opposite web part of the other clamping plate.

10. A device as claimed in claim 1, wherein said releasable tensioning means comprises three tension members, said clamping plates clampingly engaging said bolt, said tenison members being arranged in the form of a triangle, with two of the tension members being provided on one side of the bolt and the third tension member on the other side of the bolt, said clamping plates being formed with web parts through which said tension members pass.

11. A device as claimed in claim 10, wherein at least one of said tension members connecting said clamping plates on said one side of the bolt is a non-adjustable connecting web in the form of a riveted bolt.

12. A device as claimed in claim 1, wherein said holding part and said clamping plate of each angular holder are integrally formed, with said holding part comprising a holding strut which is perpendicular to said clamping plate.

* * * * *